US010634036B2

(12) United States Patent
Ito et al.

(10) Patent No.: US 10,634,036 B2
(45) Date of Patent: Apr. 28, 2020

(54) METHOD FOR MOLDING PIPE BODY

(71) Applicant: Futaba Industrial Co., Ltd., Aichi (JP)

(72) Inventors: Satoshi Ito, Aichi (JP); Masatoshi Miwa, Aichi (JP); Hiroki Minoura, Aichi (JP); Yoshinobu Ishikawa, Aichi (JP)

(73) Assignee: FUTABA INDUSTRIAL CO., LTD., Aichi (JP)

( * ) Notice: Subject to any disclaimer, the term of this patent is extended or adjusted under 35 U.S.C. 154(b) by 40 days.

(21) Appl. No.: 15/872,433

(22) Filed: Jan. 16, 2018

(65) Prior Publication Data

US 2018/0202345 A1 Jul. 19, 2018

(30) Foreign Application Priority Data

Jan. 17, 2017 (JP) ..... 2017-005793

(51) Int. Cl.
*B21D 51/10* (2006.01)
*F01N 13/18* (2010.01)
(Continued)

(52) U.S. Cl.
CPC ..... *F01N 13/18* (2013.01); *F01N 13/1861* (2013.01); *F01N 1/00* (2013.01);
(Continued)

(58) Field of Classification Search
CPC .. F01N 13/18; F01N 13/1861; F01N 2470/30; F01N 2470/28; F01N 2470/20;
(Continued)

(56) References Cited

U.S. PATENT DOCUMENTS 2,516,372 A 7/1950 Cross
2005/0172692 A1* 8/2005 Takahashi ..... B21C 37/286 72/369

FOREIGN PATENT DOCUMENTS

CN 1130551 A 9/1996
IN 6866DELNP2012 A 11/2015
(Continued)

OTHER PUBLICATIONS

English translation of the Office Action dated Nov. 26, 2019 from the Indian Patent Office, for corresponding Indian Application No. 201834001486.

(Continued)

*Primary Examiner* — Jun S Yoo
(74) *Attorney, Agent, or Firm* — David D. Brush; Westman, Champlin & Koehler, P.A.

(57) ABSTRACT

The present disclosure provides a method for molding a pipe body that can inexpensively mold a pipe body having a tapered portion radially outwardly projecting relative to a large-diameter portion. The method for molding a pipe body comprises: molding of a tubular body by bending an unfolded stock so as to wrap a core metal; and removal of the core metal from inside the tubular body. The core metal comprises a first core metal piece for molding a projecting portion of the tapered portion. During the molding of the tubular body, the first core metal piece at least partly abuts on an inner surface of the projecting portion of the tapered portion, and does not abut on an area of the inner surface of the large-diameter portion located in an opposite side of a central axis of the large-diameter portion from the projecting portion.

5 Claims, 7 Drawing Sheets

(51) Int. Cl.
*F01N 3/00* (2006.01)
*F01N 1/00* (2006.01)
*F01N 13/08* (2010.01)

(52) U.S. Cl.
CPC ..... *F01N 3/00* (2013.01); *F01N 13/08* (2013.01); *F01N 2260/14* (2013.01); *F01N 2470/18* (2013.01); *F01N 2470/20* (2013.01); *F01N 2470/28* (2013.01); *F01N 2470/30* (2013.01)

(58) Field of Classification Search
CPC .... F01N 2260/14; F01N 1/00; F01N 2470/18; F01N 3/00; F01N 13/08; B21C 3/00; B21C 3/06; B21C 3/16; B21C 37/0818; B21C 37/0803; B21C 37/155; B21C 37/156; B21C 37/158; B21C 37/16–185; B21D 22/025; B21D 31/06; B21D 41/00; B21D 41/04; B21D 51/10; B21D 53/06
See application file for complete search history.

(56) References Cited

FOREIGN PATENT DOCUMENTS

| | | | | |
|---|---|---|---|---|
| JP | 62244539 | A | * | 10/1987 |
| JP | S63278614 | A | | 11/1988 |
| JP | 2003225724 | A | | 8/2003 |
| JP | 2005169486 | A | * | 6/2005 |

OTHER PUBLICATIONS

English translation of the Chinese Office Action dated Jun. 17, 2019 from the Chinese Patent Office, for corresponding Chinese Application No. 201810043039.X.
Machine generated English translation of the Notice of Reasons(s) for Rejection dated Feb. 4, 2020 in corresponding Japanese Patent Application No. 2017/005793.

* cited by examiner

METHOD FOR MOLDING PIPE BODY

CROSS-REFERENCE TO RELATED APPLICATIONS

The present application claims the benefit of Japanese Patent Application No. 2017-005793 filed on Jan. 17, 2017 with the Japan Patent Office, the entire disclosure of which is incorporated herein by reference.

BACKGROUND

The present disclosure is related to a method for molding a pipe body.

For a converter and a muffler of a vehicle, a pipe body comprising a large-diameter portion and a small-diameter portion, and a tapered portion that connects the large-diameter portion and the small-diameter portion is used. For a method for molding such pipe body, Japanese Unexamined Patent Application Publication No. 2003-225724, for example, discloses a known method involving cutting, drawing, and bending a plate stock around a core metal.

SUMMARY

In some cases, in a pipe body including a large-diameter portion, a tapered portion is required to be formed such that a portion of the outer circumference of the tapered portion radially outwardly projects relative to the outer circumference of the large-diameter portion. To mold a pipe body in such a shape with a core metal, the core metal cannot be removed from the pipe body after the aforementioned bending process. In conventional methods, a pipe body is first molded without a projection, then a bending process needs to be performed on the pipe body so as to make a projecting portion of the tapered portion. In this way, several instances of the bending process may be required, which becomes one of the factors to increase the cost for pipe body molding.

It is preferable that one aspect of the present disclosure provides a method to inexpensively form a pipe body comprising a tapered portion radially outwardly projecting relative to a large-diameter portion.

One aspect of the present disclosure provides a method for molding a pipe body. The pipe body includes a large-diameter portion and a tapered portion continuously extending from the large-diameter portion. The tapered portion is tapered from a side in a vicinity of the large-diameter portion toward an opposite side away from the large-diameter portion. The tapered portion includes a projecting portion located at a portion of an outer circumference of the tapered portion. The projecting portion outwardly projects in a radial direction of the large-diameter portion relative to an outer circumference of the large-diameter portion. The method for molding a pipe body comprises forming of an unfolded stock, disposition of a core metal, molding of a tubular body including the large-diameter portion and the tapered portion, and removal of the core metal from inside the tubular body. The forming of the unfolded stock is performed by drawing a plate stock into a cylindrical body that is opened along a line parallel to a central axis of the cylindrical body. The disposition of a core metal is performed by disposing the core metal on a surface of the unfolded stock that corresponds to an inner surface of the pipe body. The molding of a tubular body is performed by bending the unfolded stock so as to wrap the core metal. The core metal comprises a first core metal piece for molding the projecting portion of the tapered portion. During the molding of the tubular body, the first core metal piece at least partly abuts on an inner surface of the projecting portion of the tapered portion, and does not abut on an area of the inner surface of the large-diameter portion located in an opposite side of a central axis of the large-diameter portion from the projecting portion of the tapered portion.

This method allows removal of the first core metal piece for molding the projecting portion of the tapered portion from the tubular body having the tapered portion radially outwardly projecting relative to the large-diameter portion along the central axis of the tubular body. In other words, a single bending process with the core metal can mold the pipe body such that the tapered portion radially outwardly projects relative to the large-diameter portion. This can omit a secondary processing for making the projecting portion of the tapered portion. The pipe body having the tapered portion radially outwardly projecting relative to the large-diameter portion thus can be inexpensively produced.

In another aspect of the present disclosure, the core metal may further comprise a second core metal piece for molding the large-diameter portion. Moreover, during the molding of the tubular body, the second core metal piece may abut on an area of an inner surface of the large-diameter portion located in the opposite side of the central axis of the large-diameter portion from the projecting portion of the tapered portion. This allows more accurate molding of a pipe body.

In still another aspect of the present disclosure, the removal of the core metal may comprise: moving of the first core metal piece within the tubular body away from the projecting portion of the tapered portion; and removal of the first core metal piece and the second core metal piece from the large-diameter portion in a direction away from the tapered portion upon the moving of the first core metal piece. This allows easy and reliable removal of the core metal from the tubular body.

In still another aspect of the present disclosure, the removal of the core metal may comprise: removal of the first core metal piece from the tapered portion in a direction away from the large-diameter portion; and removal of the second core metal piece from the large-diameter portion in a direction away from the tapered portion upon the removal of the first core metal piece. This also allows easy and reliable removal of the core metal from the tubular body.

In still another aspect of the present disclosure, the removal of the core metal may comprise: removal of the second core metal piece from the large-diameter portion in a direction away from the tapered portion; and removal of the first core metal piece from the large-diameter portion in a direction away from the tapered portion upon the removal of the second core metal piece. This also allows easy and reliable removal of the core metal from the tubular body.

BRIEF DESCRIPTION OF THE DRAWINGS

An example embodiment of the present disclosure will be described hereinafter by way of example with reference to the accompanying drawings, in which.

DETAILED DESCRIPTION OF THE PREFERRED EMBODIMENTS

1. First Embodiment

[1-1. Structure]

Figure 1:
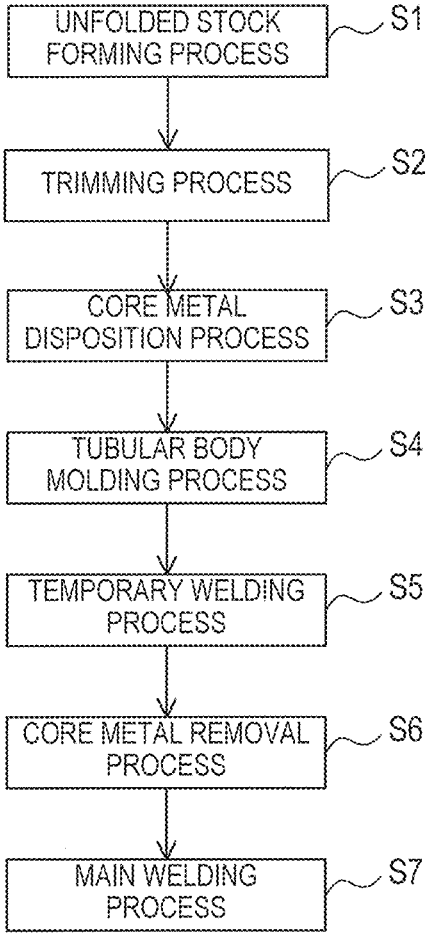
FIG. 1 is a flowchart illustrating a method for molding a pipe body according to an embodiment of the present disclosure.

A method for molding a pipe body illustrated in FIG. 1 is a method for molding a pipe body 1 shown in FIGS. 2A, 2B, 2C, and 2D. The pipe body 1 is used for, for example, mufflers and converters of vehicles.

The pipe body 1 comprises a large-diameter portion 2, and a tapered portion 3 continuously extending from the large-diameter portion 2. The large-diameter portion 2 is linearly shaped and has a constant diameter. The tapered portion 3 is configured such that its diameter decreases from a side in the vicinity of the large-diameter portion 2 toward the opposite side away from the large-diameter portion 2. Being "tapered" described herein means that the diameter of a pipe body is decreased toward its central axis, and a pipe body having a curved outer edge in its central cross-section is included in the concept of being "tapered".

In the pipe body 1, the central axis of the large-diameter portion 2 and the central axis of the tapered portion 3 intersect at a specified angle. In other words, the central axis of the tapered portion 3 is deflected from the central axis of the large-diameter portion 2. The pipe body 1 has a composite shape in which a portion of the outer circumference of the tapered portion 3 (hereinafter to be also referred to as a "projecting portion 3A") projects radially outside of the outer circumference of the large-diameter portion 2. That is, when viewed in the direction of the central axis of the large-diameter portion 2, the projecting portion 3A of the tapered portion 3 is located outside of the outer circumference of the large-diameter portion 2.

The method for molding a pipe body illustrated in FIG. 1 comprises an unfolded stock forming process S1, a trimming process S2, a core metal disposition process S3, a tubular body molding process S4, a temporary welding process S5, a core metal removal process S6, and a main welding process S7.

<Unfolded Stock Forming Process>

In this process, a plate stock is drawn into a cylindrical body opened along a line parallel to its central axis. The plate stock formed into this state will be referred to as an unfolded stock. Examples of the plate stock to which the drawing is performed include a tailored blank and a roughly shaped blank.

<Trimming Process>

Figure 3A:
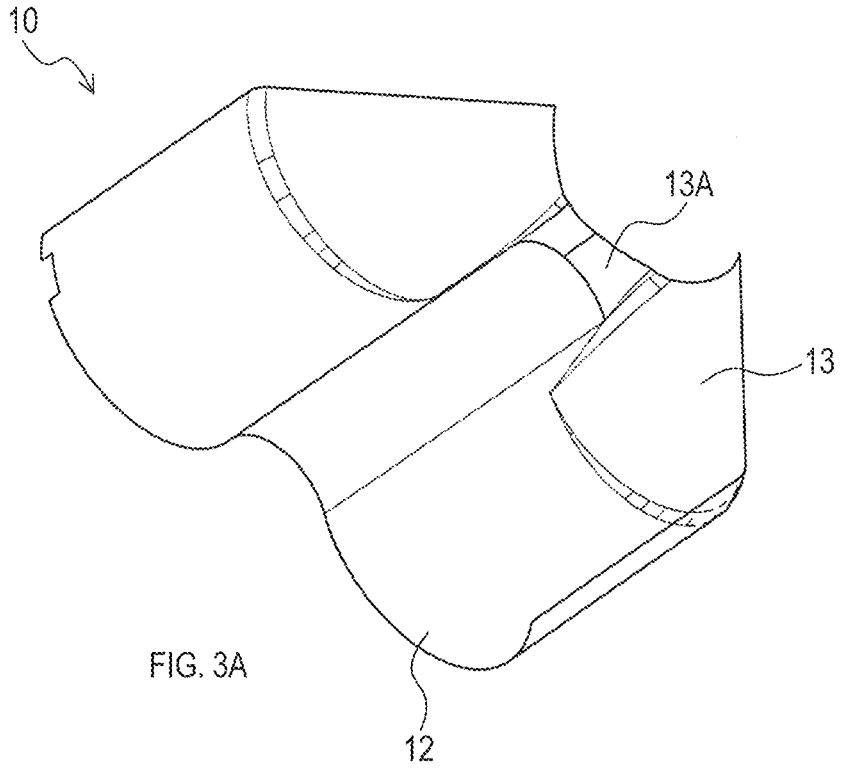
FIG. 3A is a schematic perspective view showing an unfolded stock formed in accordance with the method for molding a pipe body according to the embodiment.

In this process, the unfolded stock obtained by drawing in the unfolded stock forming process S1 is trimmed. The trimmed unfolded stock obtained in this process will be referred to as an unfolded stock 10 as shown in FIG. 3A. The unfolded stock 10 comprises a first portion 12 corresponding to the large-diameter portion 2 of the pipe body 1 and a second portion 13 corresponding to the tapered portion 3 of the pipe body 1. The second portion 13 comprises a projecting portion forming area 13A corresponding to the projecting portion 3A of the pipe body 1. The unfolded stock 10 is shaped by cutting the cylindrical body with the first portion 12 and the second portion 13 at a portion of its outer circumference that radially faces the projecting portion forming area 13A along a line parallel to the central axis of the cylindrical body.

A portion of the unfolded stock 10, except for the projecting portion forming area 13A, that is located, when the unfolded stock 10 is formed into a cylindrical shape, in the inner surface of the cylindrical shape toward the projecting portion forming area 13A relative to the central axis of the cylindrical shape is curved like a protrusion toward the central axis. The projecting portion forming area 13A is formed, on the other hand, in a flat surface. This structure inhibits wrinkles from being formed in the projecting portion 3A when the unfolded stock 10 is molded.

<Core Metal Disposition Process>

In this process, a core metal having an outer shape formed along the shape of the pipe body 1 is disposed on a surface that will be the inner surface of the pipe body 1 of the unfolded stock 10 acquired in the trimming process S2. To be specific, the core metal is disposed in a position where core metal overlaps with the central axis of the unfolded stock 10.

Figure 4A:
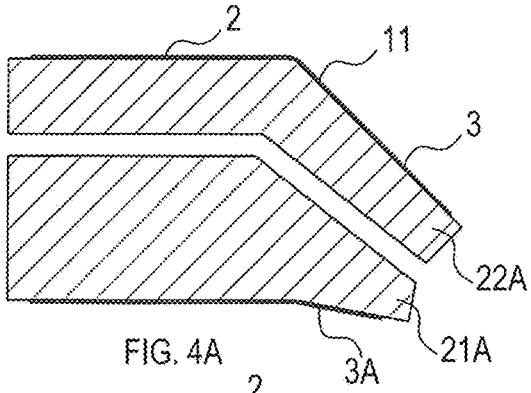
FIG. 4A is a schematic sectional view showing a layout of a core metal in the method for molding a pipe body according to the embodiment.

The core metal of the present embodiment is formed, as shown in FIG. 4A, by combining divided pieces. This core metal comprises two divided pieces: a first core metal piece 21A for molding the projecting portion 3A; and a second core metal piece 22A for molding the large-diameter portion 2.

The first core metal piece 21A is disposed so as to, in the subsequent tubular body molding process S4, at least partly abut on the entire inner surface of the projecting portion 3A of the tapered portion 3. The first core metal piece 21A does not abut on an area of the inner surface of the tapered portion 3 located in the opposite side of the central axis of the tapered portion 3 from the projecting portion 3A (in other words, in a portion facing the projecting portion 3A) (hereinafter to be also referred to as "projecting portion facing area"). Moreover, the first core metal piece 21A does not abut on an area of the inner surface of the large-diameter portion 2 located in the opposite side of the central axis of the large-diameter portion 2 from the projecting portion 3A of the tapered portion 3 (in the upper side in the drawing) (hereinafter to be also referred to as an "upper area").

Specifically, the first core metal piece 21A is a columnar body that abuts on the entire inner surface of the projecting portion 3A of the tapered portion 3 and an area of the inner surface of the large-diameter portion 2 located toward the projecting portion 3A relative to the central axis of the large-diameter portion 2 (in the lower side in the drawing) (hereinafter to be also referred to as "lower area"). A portion of the outer surface (that is, the upper surface) of the first core metal piece 21A that does not abut on the inner surface of a tubular body 11 is formed parallel to the central axis of the large-diameter portion 2 and the central axis of the tapered portion 3.

On the other hand, the second core metal piece 22A is disposed so as to face the first core metal piece 21A radially away from the first core metal piece 21A by a specified distance. The second core metal piece 22A is disposed so as to, in the subsequent tubular body molding process S4, abut on the upper area of the large-diameter portion 2.

Specifically, the second core metal piece 22A is a columnar body that abuts on the inner surface of the large-diameter portion 2 and an area of the inner surface of the tapered portion 3 where the first core metal piece 21A does not abut on, that is, the upper area and the projecting portion facing area. A portion of the outer surface of the second core metal piece 22A that does not abut on the inner surface of the tubular body 11 (that is, the lower surface) is formed parallel to the central axis of the large-diameter portion 2 and the central axis of the tapered portion 3.

The first core metal piece 21A is disposed so as to be away in the radial direction of the tubular body 11 from the second core metal piece 22A by a specified distance. The distance between the first core metal piece 21A and the second core metal piece 22A is determined such that the first core metal piece 21A can be moved inwardly relative to the outer circumference of the large-diameter portion 2 in the core metal removal process S6 which will be described later.

<Tubular Shape Molding Process>

Figure 3B:
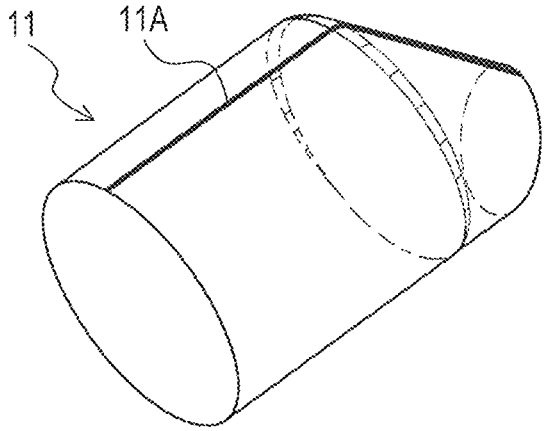
FIG. 3B is a schematic perspective view showing a tubular body molded in accordance with the method for molding a pipe body according to the embodiment.

In this process, the unfolded stock 10 is bent, as shown in FIG. 3B, such that the core metal disposed thereon in the core metal disposition process S3 is wrapped so as to mold the tubular body 11. Specifically, the unfolded stock 10 is bent along the outer shape of the core metal, and the edges of the unfolded stock 10 are abutted on each other so as to form the outer shape of the pipe body 1. Consequently, the tubular body 11 having the outer shape of the pipe body 1, that is, the tubular body 11 having the large-diameter portion 2 and the tapered portion 3 is molded.

<Temporary Welding Process>

In this process, the tubular body 11 molded in the tubular body molding process S4 is temporarily secured by partly welding the edges of the unfolded stock 10 by, for example, TIG (Tungsten-Inert Gas) welding.

<Core Metal Removal Process>

In this process, the core metal is removed from inside the tubular body 11. Specifically, this process comprises: moving the first core metal piece 21A within the tubular body 11 away from the projecting portion 3A of the tapered portion 3; and, upon moving the first core metal piece 21A, removing the first core metal piece 21A and the second core metal piece 22A from the large-diameter portion 2 in the direction away from the tapered portion 3.

Figure 4B:
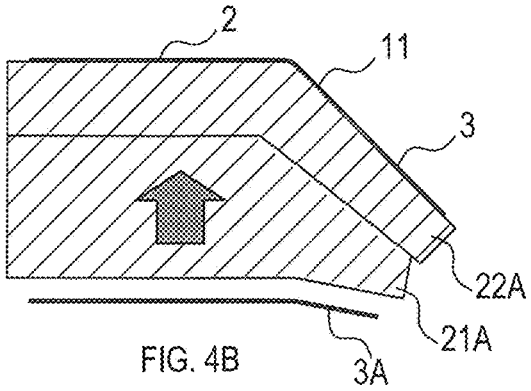
FIG. 4B is a schematic sectional view illustrating a state of the core metal in which a first core metal piece for molding a projecting portion in FIG. 4A has been moved.

In the present embodiment, as shown in FIG. 4B, the first core metal piece 21A is moved in the radial direction of the large-diameter portion 2 so as to abut on the second core metal piece 22A, and then moved away from the projecting portion 3A. When viewed from the direction of the central axis of the large-diameter portion 2, the first core metal piece 21A is moved inwardly relative to the outer circumference of the large-diameter portion 2. Consequently, the first core metal piece 21A can be removed together with the second core metal piece 22A from the large-diameter portion 2 of the tubular body 11 in the direction away from the tapered portion 3.

<Main Welding Process>

Figure 2A:
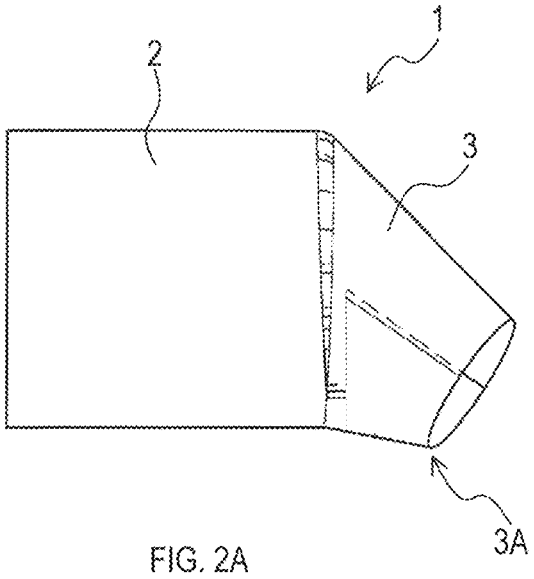
FIG. 2A is a schematic front view of a pipe body molded in accordance with the method for molding a pipe body according to the embodiment.
Figure 2C:
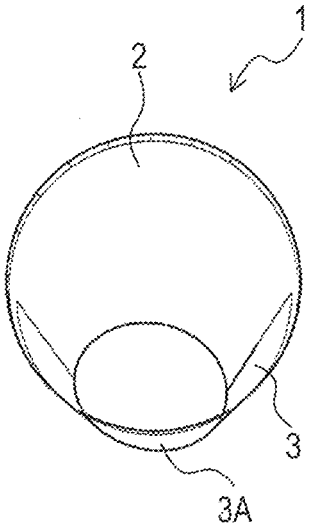
FIG. 2C is a schematic right lateral view showing the pipe body in FIG. 2A.
Figure 2B:
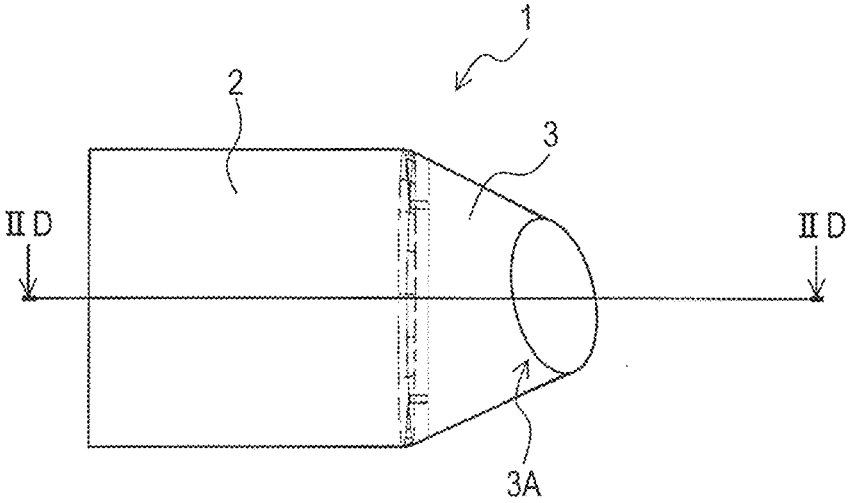
FIG. 2B is a schematic bottom view showing the pipe body in FIG. 2A.
Figure 2D:
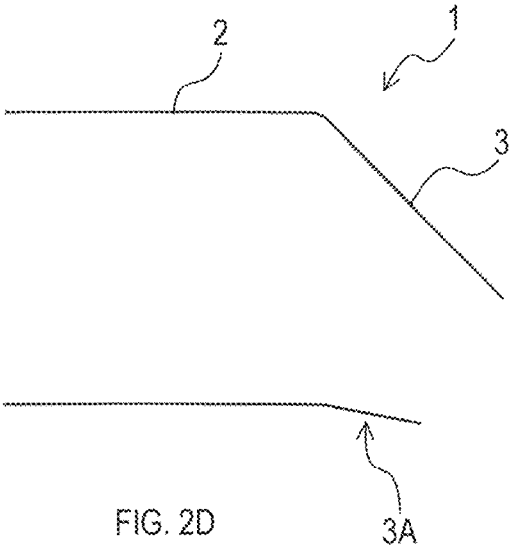
FIG. 2D is a schematic sectional view showing the pipe body cut along a line IID-IID in FIG. 2B.

In this process, the tubular body 11, from which the core metal has been removed in the core metal removal process S6, is completely welded at a joint portion 11A, shown in FIG. 3B, where the edges of the unfolded stock 10 are joined. As a result, the pipe body 1 shown in FIG. 2A is acquired.

The acquired pipe body 1 may be provided with a small-diameter portion having a constant and smaller diameter than the large-diameter portion 2 at the end of the tapered portion 3 located in the opposite side of the large-diameter portion 2. The small-diameter portion may be formed by performing spinning on the tapered portion 3 with a roller. The small-diameter portion may be formed, for example, by necking, bulge molding, burring molding, or bending molding.

[1-2. Effect]

According to the above-described embodiment, the following effect can be achieved.

(1a) In the tubular body molding process S4, the first core metal piece 21A for molding the projecting portion 3A does not abut on an area of the inner surface of the large-diameter portion 2 located in the opposite side of the projecting portion 3A of the tapered portion 3. Accordingly, moving the first core metal piece 21A within the tubular body 11, in which the tapered portion 3 is radially outwardly projecting relative to the large-diameter portion 2, allows removal of the first core metal piece 21A from the large-diameter portion 2 along the central axis of the tubular body 11 in the direction away from the tapered portion 3. In other words, a single bending process with the core metal can mold the pipe body 1 such that the tapered portion 3 radially outwardly projects relative to the large-diameter portion 2. This can omit a secondary processing for making the projecting portion 3A of the tapered portion 3. The pipe body 1 thus can be inexpensively produced.

(1b) In the tubular body molding process S4, the second core metal piece 22A for molding the large-diameter portion 2 abuts on an area of the inner surface of the large-diameter portion 2 located in the opposite side to the projecting portion 3A of the tapered portion 3. This improves the accuracy in molding the pipe body 1.

2. Second to Ninth Embodiments

The methods for forming a pipe body according to the second to the ninth embodiments are similar to that of the first embodiment except that the core metals used therein are different. In other words, in the following embodiments, the unfolded stock forming process S1, the trimming process S2, the core metal disposition process S3, the tubular body molding process S4, the temporary welding process S5, and the main welding process S7 are similar to those in the first embodiment. The description of these processes will be omitted here.

Second Embodiment

Figure 4C:
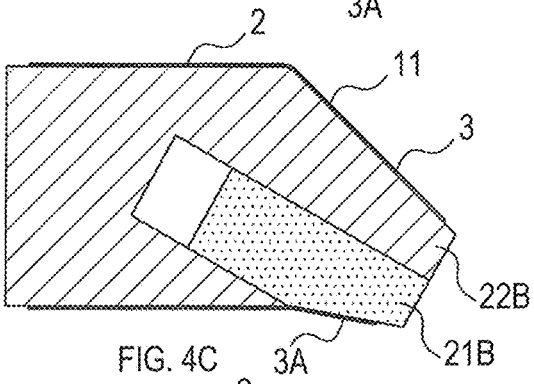
FIG. 4C is a schematic sectional view illustrating a layout of a core metal in a method for molding a pipe body according to an embodiment that is different from the embodiment in FIG. 4A.

In the method for molding a pipe body according to a second embodiment, a core metal shown in FIG. 4C is used. The core metal comprises two divided pieces: a first core metal piece 21B for molding the projecting portion 3A; and a second core metal piece 22B for molding the large-diameter portion 2.

In the tubular body molding process S4, the first core metal piece 21B abuts on the entire inner surface of the projecting portion 3A of the tapered portion 3. The first core metal piece 21B is a columnar body having an outer surface extending parallel to the central axis of the tapered portion 3. The first core metal piece 21B does not abut on the upper area of the large-diameter portion 2 and the projecting portion facing area of the tapered portion 3. The first core metal piece 21B is supported by the second core metal piece 22B in a slidable manner along the central axis of the tapered portion 3 toward the large-diameter portion 2.

The second core metal piece 22B abuts on the inner surface of the large-diameter portion 2 and of the tapered portion 3 except an area of the projecting portion 3A of the tapered portion 3. The second core metal piece 22B has an internal space in which the first core metal piece 21B is slidable along the central axis of the tapered portion 3. In the core metal disposition process S3, the first core metal piece 21B is disposed in this space so as to abut on the projecting portion 3A. The first core metal piece 21B is supported by, for example, an elastic body such as a spring, or a cylinder.

Figure 4D:
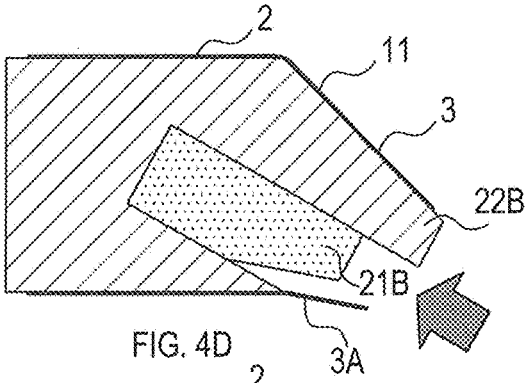
FIG. 4D is a schematic sectional view illustrating a state of the core metal in which a first core metal piece for molding the projecting portion in FIG. 4C has been moved.

In the core metal removal process S6 in the present embodiment, the first core metal piece 21B is slid, as shown in FIG. 4D, along the central axis of the tapered portion 3 in a direction away from the projecting portion 3A (that is, toward the large-diameter portion 2). This structure allows removal of the first core metal piece 21B together with the second core metal piece 22B from the large-diameter portion 2 of the tubular body 11 in the direction away from the tapered portion 3.

Third Embodiment

Figure 4E:
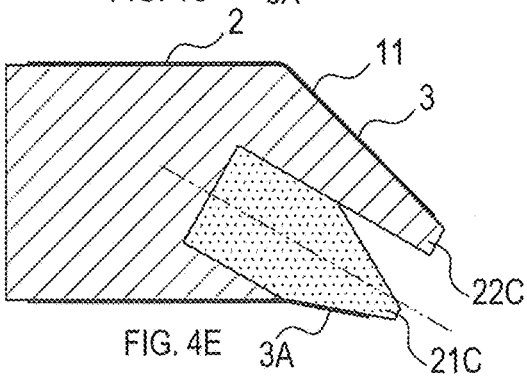
FIG. 4E is a schematic sectional view illustrating a layout of a core metal in a method for molding a pipe body according to an embodiment that is different from the embodiments in FIG. 4A and FIG. 4C.

In the method for molding a pipe body according to a third embodiment, a core metal shown in FIG. 4E is used. The core metal comprises two divided pieces: a first core metal piece 21C for molding the projecting portion 3A; and a second core metal piece 22C for molding the large-diameter portion 2.

In the tubular body molding process S4, the first core metal piece 21C abuts on the entire inner surface of the projecting portion 3A of the tapered portion 3. The first core metal piece 21C is a columnar body having a central axis parallel to the central axis of the tapered portion 3. The first core metal piece 21C does not abut on the upper area of the large-diameter portion 2 and the projecting portion facing area of the tapered portion 3. The first core metal piece 21C is supported by the second core metal piece 22C in a rotatable manner on its central axis (that is, in a spinnable manner).

The first core metal piece 21C is formed asymmetrically relative to its central axis. The first core metal piece 21C is configured to be rotated on its central axis and moved away from the projecting portion 3A so that, when viewed in the direction of the central axis of the large-diameter portion 2, the first core metal piece 21C is moved to the inner area of the large-diameter portion 2 relative to the outer circumference of the large-diameter portion 2.

The second core metal piece 22C abuts on the inner surface of the large-diameter portion 2 and the tapered portion 3 except an area of the projecting portion 3A of the tapered portion 3. The second core metal piece 22C comprises an internal space in which the first core metal piece 21C is rotatable on its central axis. In the core metal disposition process S3, the first core metal piece 21C is disposed in this space so as to abut on the projecting portion 3A.

Figure 4F:
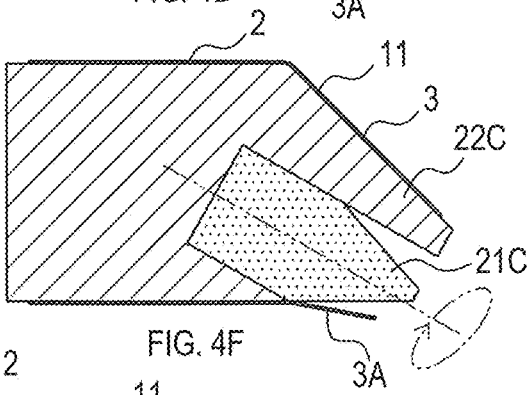
FIG. 4F is a schematic sectional view illustrating a state of the core metal in which a first core metal piece for molding the projecting portion in FIG. 4E has been moved.

In the core metal removal process S6 in the present embodiment, the first core metal piece 21C is rotated on its central axis and moved away from the projecting portion 3A as shown in FIG. 4F. This structure allows removal of the first core metal piece 21C together with the second core metal piece 22C from the large-diameter portion 2 of the tubular body 11 in the direction away from the tapered portion 3.

Fourth Embodiment

Figure 4G:
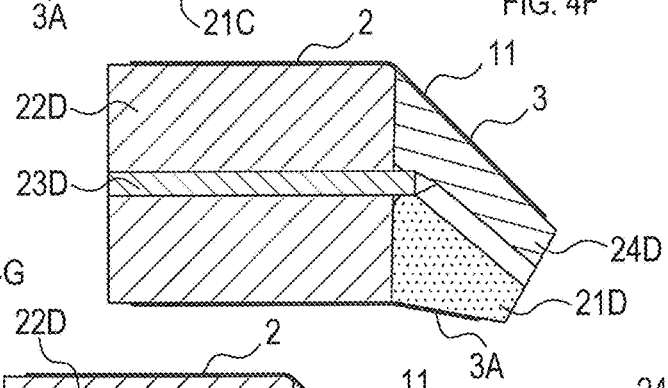
FIG. 4G is a schematic sectional view illustrating a layout of a core metal in a method for molding a pipe body according to an embodiment that is different from the embodiments in FIG. 4A, FIG. 4C and FIG. 4E.

In the method for molding a pipe body according to a fourth embodiment, a core metal shown in FIG. 4G is used. The core metal comprises six divided pieces: a first core metal piece 21D for molding the projecting portion 3A; a second core metal piece 22D for molding the large-diameter portion 2; a first auxiliary core metal piece 23D; a second auxiliary core metal piece 24D; a third auxiliary core metal piece 25D (see FIG. 4I); and a fourth auxiliary core metal piece 26D (see FIG. 4I).

The first core metal piece 21D abuts on the entire inner surface of the projecting portion 3A of the tapered portion 3. The first core metal piece 21D does not abut on the inner surface of the large-diameter portion 2 and the projecting portion facing area of the tapered portion 3. A portion of the outer surface of the first core metal piece 21D that does not abut on the inner surface of the tubular body 11 and is located toward the large-diameter portion 2 abuts on the second core metal piece 22D. The outer surface of the first core metal piece 21D located in the opposite side from the projecting portion 3A in the radial direction of the tapered portion 3 (that is, the upper surface) abuts on the third auxiliary core metal piece 25D and the fourth auxiliary core metal piece 26D.

The second core metal piece 22D is a columnar body that abuts on the entire inner surface of the large-diameter portion 2. The second core metal piece 22D is provided with a through hole penetrating the large-diameter portion 2 along the central axis of the large-diameter portion 2. Into this through hole, the first auxiliary core metal piece 23D is inserted.

The first auxiliary core metal piece 23D is a rod-like body and is inserted into the through hole of the second core metal piece 22D in the core metal disposition process S3. The tip of the rod-like body then reaches a gap between the first core metal piece 21D, the second auxiliary core metal piece 24D, the third auxiliary core metal piece 25D, and the fourth auxiliary core metal piece 26D disposed in the tapered portion 3.

The second auxiliary core metal piece 24D, the third auxiliary core metal piece 25D, and the fourth auxiliary core metal piece 26D abut on an area of the inner surface of the tapered portion 3 where the first core metal piece 21D does not abut on. The second auxiliary core metal piece 24D abuts on the third auxiliary core metal piece 25D and the fourth auxiliary core metal piece 26D.

Due to the tip portion of the first auxiliary core metal piece 23D, the first core metal piece 21D, the second auxiliary core metal piece 24D, the third auxiliary core metal piece 25D, and the fourth auxiliary core metal piece 26D are disposed in the tapered portion 3 so as to be spaced apart from one another by a specific distance in the radial direction of the tapered portion 3. The distance between the first core metal piece 21D, the second auxiliary core metal piece 24D, the third auxiliary core metal piece 25D, and the fourth auxiliary core metal piece 26D is determined such that, in the core metal removal process S6, the first core metal piece 21D can be moved inwardly relative to the outer circumference of the large-diameter portion 2.

Figure 4H:
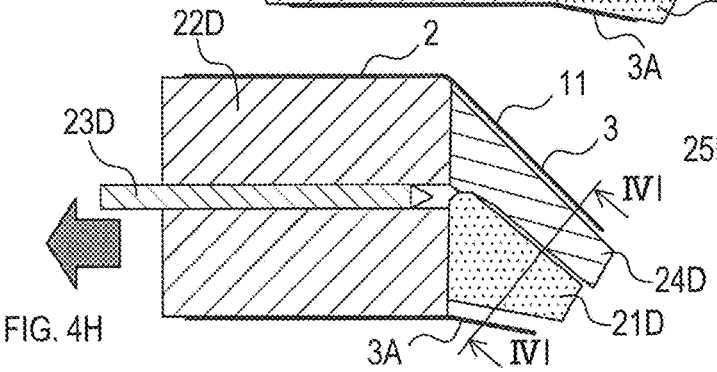
FIG. 4H is a schematic sectional view illustrating a state of the core metal in which a first core metal piece for molding the projecting portion in FIG. 4G has been moved.
Figure 4I:
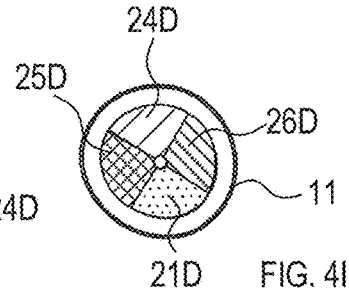
FIG. 4I is a schematic sectional view showing the first core metal piece cut along a line IVI-IVI in FIG. 4H.

In the core metal removal process S6 in the present embodiment, firstly, as shown in FIG. 4H, the first auxiliary core metal piece 23D is removed from the large-diameter portion 2 in the direction away from the tapered portion 3. Subsequently, as shown in FIGS. 4H and 4I, the first core metal piece 21D, the second auxiliary core metal piece 24D, the third auxiliary core metal piece 25D, and the fourth auxiliary core metal piece 26D are moved toward the central axis of the tapered portion 3 so as to separate the first core metal piece 21D from the projecting portion 3A. This allows individual removal of the first core metal piece 21D, the second auxiliary core metal piece 24D, the third auxiliary core metal piece 25D, and the fourth auxiliary core metal piece 26D from the large-diameter portion 2 of the tubular body 11 in the direction away from the tapered portion 3. The number of the core metal pieces disposed in the tapered portion 3 (the total number of the first core metal piece for molding the projecting portion 3A and the auxiliary core metal pieces) is not limited to four; the number may be two, three, five or more.

Fifth Embodiment

Figure 5A:
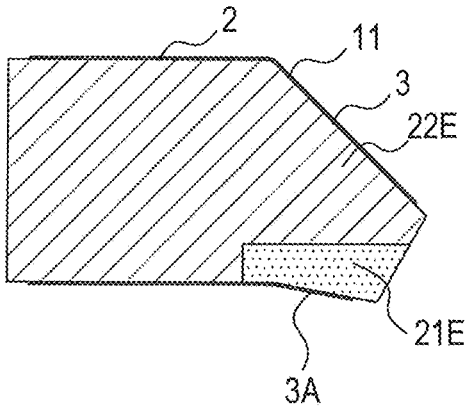
FIG. 5A is a schematic sectional view illustrating a layout of a core metal in a method for molding a pipe body according to an embodiment.

In the method for molding a pipe body according to a fifth embodiment, a core metal shown in FIG. 5A is used. The core metal comprises two divided pieces: a first core metal piece 21E for molding the projecting portion 3A; and a second core metal piece 22E for molding the large-diameter portion 2.

In tubular body molding process S4, the first core metal piece 21E abuts on the entire inner surface of the projecting portion 3A of the tapered portion 3 and a portion of the inner surface of the large-diameter portion 2 continuously extending to the projecting portion 3A. The first core metal piece 21E does not abut on the upper area of the large-diameter portion 2 and the projecting portion facing area of the tapered portion 3. A portion of the outer surface of the first core metal piece 21E that does not abut on the tubular body 11 abuts on the second core metal piece 22E.

The second core metal piece 22E abuts on an area of the inner surface of the large-diameter portion 2 and the tapered portion 3 where the first core metal piece 21E does not abut on. The second core metal piece 22E is formed into a columnar body extending along the shape of the tubular body 11 in such a manner that a portion of the columnar body in the vicinity of the projecting portion 3A is cut out. Into this cut-out portion, the first core metal piece 21E is fitted.

Figure 5B:
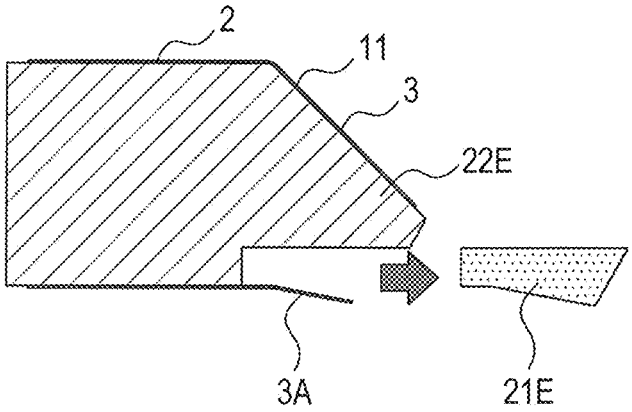
FIG. 5B is a schematic sectional view illustrating a state of the core metal in which a first core metal piece for molding the projecting portion in FIG. 5A has been removed.

In the present embodiment, the core metal removal process S6 comprises removing the first core metal piece 21E, as shown in FIG. 5B, from the tapered portion 3 in the direction away from the large-diameter portion 2 and, upon removing the first core metal piece 21E, removing the second core metal piece 22E from the large-diameter portion 2 in the direction away from the tapered portion 3. Through the removal of both pieces, all the core metal pieces 21E and 22E can be removed from the tubular body 11.

Sixth Embodiment

Figure 6A:
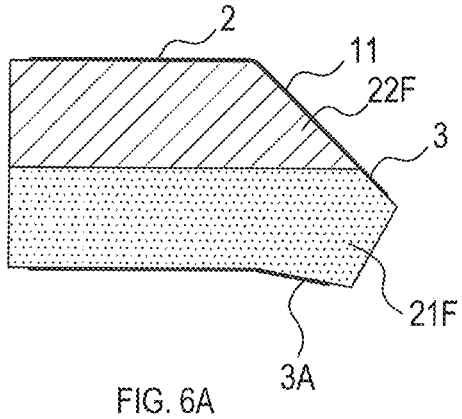
FIG. 6A is a schematic sectional view illustrating a layout of a core metal in method for molding a pipe body according to an embodiment.

In the method for molding a pipe body according to a six embodiment, a core metal shown in FIG. 6A is used. The core metal comprises two divided pieces: a first core metal piece 21F for molding the projecting portion 3A; and a second core metal piece 22F for molding the large-diameter portion 2.

The first core metal piece 21F is a columnar body that abuts on the entire inner surface of the projecting portion 3A of the tapered portion 3, a portion in the tip side (that is, opposite to the side toward the large-diameter portion 2) of the projecting portion facing area of the tapered portion 3, and the lower area of the large-diameter portion 2 in tubular body molding process S4. A portion of the outer surface of the first core metal piece 21F that does not abut on the inner surface of the tubular body 11 (that is, the upper outer surface of the first core metal piece 21F) is parallel to the central axis of the large-diameter portion 2.

The second core metal piece 22F is a columnar body that abuts on an area of the inner surface of the large-diameter portion 2 and the tapered portion 3 where the first core metal piece 21F does not abut on. A portion of the outer surface of the second core metal piece 22F that does not abut on the inner surface of the tubular body 11 (that is the lower outer surface of the second core metal piece 22F) is parallel to the central axis of the large-diameter portion 2 and abuts on the first core metal piece 21F.

Figure 6B:
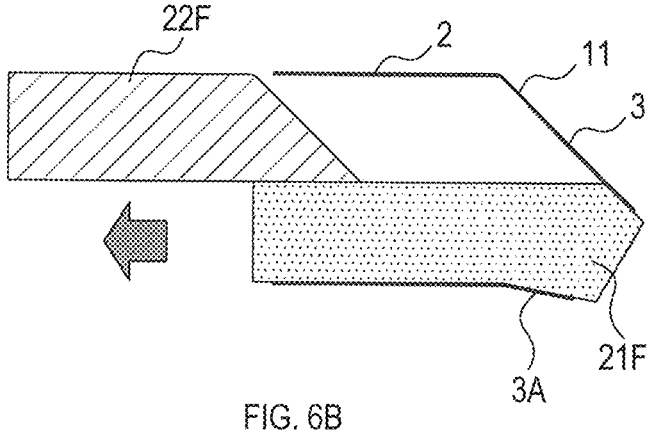
FIG. 6B is a schematic sectional view illustrating a state of the core metal in which a second core metal piece for molding a large-diameter portion in FIG. 6A has been removed.

The core metal removal process S6 in the present embodiment comprises removing the second core metal piece 22F, as shown in FIG. 6B, from the large-diameter portion 2 in the direction away from the tapered portion 3 and, upon removing the second core metal piece 22F, removing the first core metal piece 21F from the large-diameter portion 2 in the direction away from the tapered portion 3.

Through the use of the space created after removing the second core metal piece 22F, the first core metal piece 21F can be moved within the tubular body 11 toward the central axis of the tubular body 11. In this way, the first core metal piece 21F can be removed from the large-diameter portion 2 in the direction away from the tapered portion 3.

Seventh Embodiment

Figure 6C:
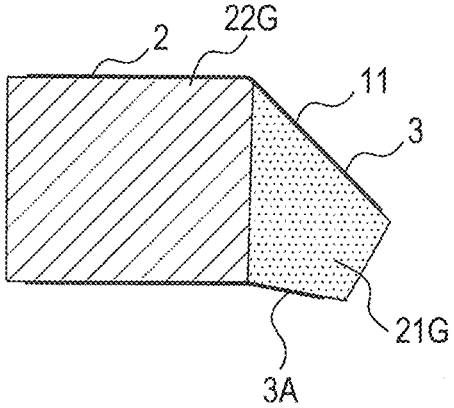
FIG. 6C is a schematic sectional view illustrating a layout of a core metal in a method for molding a pipe body according to an embodiment that is different from the embodiment in FIG. 6A.

In the method for molding a pipe body according to a seventh embodiment, a core metal shown in FIG. 6C is used. The core metal comprises two divided pieces: a first core metal piece 21G for molding the projecting portion 3A; and a second core metal piece 22G for molding the large-diameter portion 2.

In tubular body molding process S4, the first core metal piece 21G abuts on the entire inner surface of the tapered portion 3. The first core metal piece 21G does not abut on the inner surface of the large-diameter portion 2. A portion of the outer surface of the first core metal piece 21G located toward the large-diameter portion 2 (that is, the lateral outer surface of the first core metal piece 21G) abuts on the second core metal piece 22G. The second core metal piece 22G is a columnar body that abuts on the entire inner surface of the large-diameter portion 2. The lateral surface of the second core metal piece 22G located toward the tapered portion 3 abuts on the first core metal piece 21G.

Figure 6D:
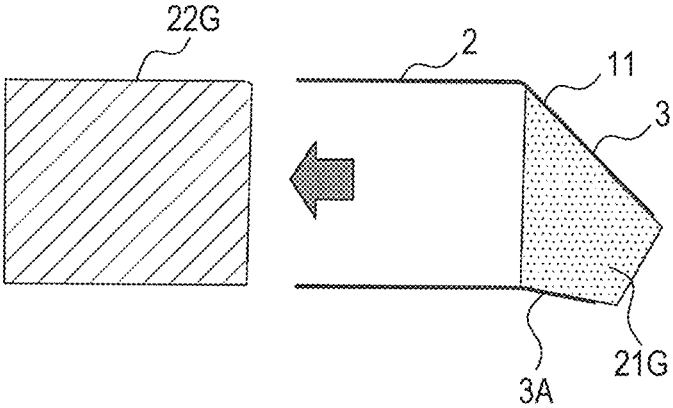
FIG. 6D is a schematic sectional view illustrating a state of the core metal in which a second core metal piece for molding the large-diameter portion in FIG. 6C has been removed.

In the core metal removal process S6 in the present embodiment, as shown in FIG. 6D, the second core metal piece 22G is removed from the large-diameter portion 2 in the same manner as in the sixth embodiment in the direction away from the tapered portion 3. This allows removal of the first core metal piece 21G from the large-diameter portion 2 in the direction away from the tapered portion 3.

Eighth Embodiment

Figure 6E:
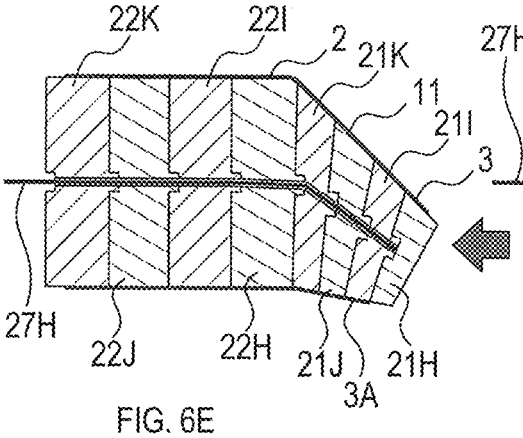
FIG. 6E is a schematic sectional view illustrating a layout of a core metal in a method for molding a pipe body according to an embodiment that is different from the embodiments in FIG. 6A and FIG. 6C.

In the method for molding a pipe body according to an eighth embodiment, a core metal shown in FIG. 6E is used. The core metal comprises pluralities of divided pieces: a plurality of first core metal pieces 21H, 21I, 21J, 21K for molding the projecting portion 3A; and a plurality of second core metal pieces 22H, 22I, 22J, 22K for molding the large-diameter portion molding 2.

The plurality of first core metal pieces 21H, 21I, 21J, 21K corresponds to the first core metal piece 21G in FIG. 6C divided into pieces in the direction of the central axis of the tapered portion 3. The plurality of second core metal pieces 22H, 22I, 22J, 22K corresponds to the second core metal piece 22G in FIG. 6C divided into pieces in the direction of the central axis of the large-diameter portion 2. In the radial center of the plurality of first core metal pieces 21H, 21I, 21J, 21K and the plurality of second core metal pieces 22H, 22I, 22J, 22K, a string-shaped member 27H is inserted. Examples of the string-shaped member 27H include a wire, a thread, and so on that can transmit tension.

In the tubular body molding process S4, the plurality of first core metal pieces 21H, 21I, 21J, 21K and the plurality of second core metal pieces 22H, 22I, 22J, 22K are joined along the central axis of the tubular body 11 so as to be disposed with a minimal gap in between.

Figure 6F:
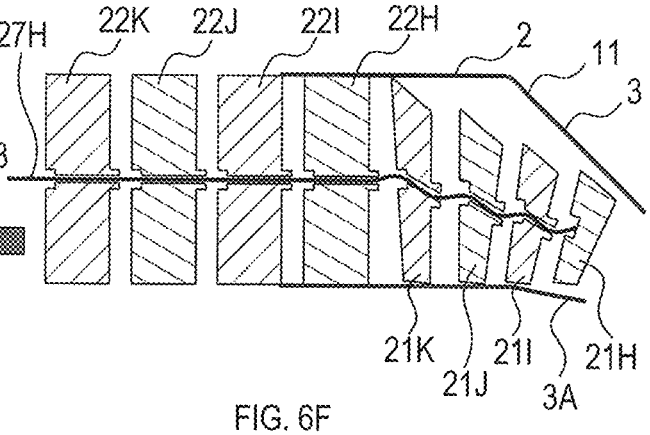
FIG. 6F is a schematic sectional view illustrating a state of the core metal in which a plurality of second core metal pieces for molding the large-diameter portion in FIG. 6E has been removed.

As shown in FIG. 6F, in the core metal removal process S6 in the present embodiment, the plurality of second core metal pieces 22H, 22I, 22J, 22K and the plurality of first core metal pieces 21H, 21I, 21J, 21K can be consecutively removed from the large-diameter portion 2 in the direction away from the tapered portion 3.

Ninth Embodiment

Figure 7A:
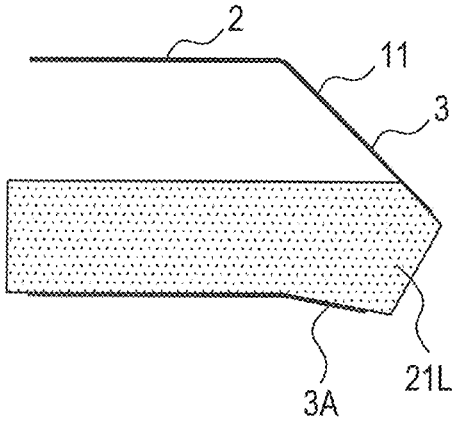
FIG. 7A is a schematic sectional view illustrating a layout of a core metal in a method for molding a pipe body according to an embodiment.

In the method for molding a pipe body according to a ninth embodiment, a core metal shown in FIG. 7A is used. The core metal shown in FIG. 7A comprises a single first core metal piece 21L for molding the projecting portion 3A. The first core metal piece 21L is similar to the first core metal piece 21F in FIG. 6A.

Figure 7B:
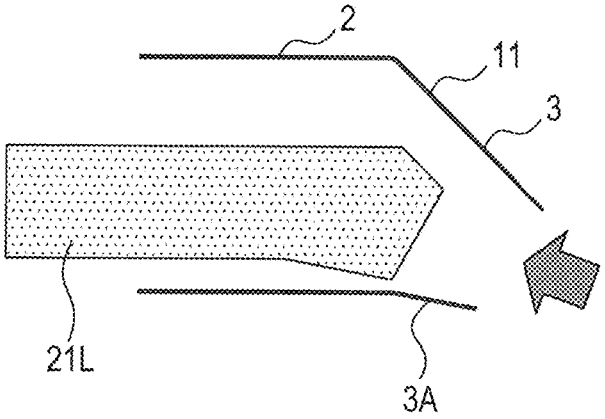
FIG. 7B is a schematic sectional view illustrating removal of a first core metal piece for molding the projecting portion in FIG. 7A.

In the present embodiment, no other core metal is placed on the first core metal piece 21L. In the core metal removal process S6, the first core metal piece 21L is shifted toward the central axis within the tubular body 11 as shown in FIG. 7B and thus can be removed from the large-diameter portion 2 in the direction away from the tapered portion 3.

3. Other Embodiments

The above has described the embodiments of the present disclosure; nevertheless, the present disclosure is not limited to the aforementioned embodiments and can be carried out in various ways.

(3a) The number of the first core metal pieces and the second core metal pieces in each of the above-described embodiments can be changed. Accordingly, the first core metal piece(s) and/or the second core metal piece(s) may be further divided into any number of pieces.

(3b) In the method for molding a pipe body in each of the aforementioned embodiment, the temporary welding process S5 is not an essential process and thus can be omitted. The main welding process S7 can be performed prior to the core metal removal process S6. Other processes can be optionally performed in addition to or instead of the aforementioned processes.

(3c) One or more function(s) possessed by a single component in the above-described embodiments may be distributed to a plurality of components. One or more function(s) possessed by a plurality of components may be integrated and assigned to a single component. Furthermore, a plurality of functions possessed by a plurality of components may be achieved by one component, or one function achieved by a plurality of components may be achieved by one component. At least a part of the configurations of the above-described embodiments may omitted, or may be added to or altered with the configurations of other embodiments. Various aspects included in the technical ideas specified only by the languages recited in the claims correspond to the embodiments of the present disclosure.

What is claimed is:

1. A method for molding a pipe body including a large-diameter portion and a tapered portion continuously extending from the large-diameter portion, the tapered portion being tapered from a side in a vicinity of the large-diameter portion toward an opposite side away from the large-diameter portion, the tapered portion including a projecting portion located at a portion of an outer circumference of the tapered portion, the projecting portion outwardly projecting in a radial direction of the large-diameter portion relative to an outer circumference of the large-diameter portion, the method comprising:

forming of an unfolded stock by drawing a plate stock into a cylindrical body that is opened along a line parallel to a central axis of the cylindrical body;

disposition of a core metal on a surface of the unfolded stock that is shaped by cutting the cylindrical body, the surface corresponding to an inner surface of the pipe body;

molding of a tubular body including the large-diameter portion and the tapered portion by bending the unfolded stock so as to wrap the core metal; and removal of the core metal from inside the tubular body, wherein the core metal comprises a first core metal piece for molding the projecting portion of the tapered portion, and wherein, during the molding of the tubular body, the first core metal piece at least partly abuts on an inner surface of the projecting portion of the tapered portion, and does not abut on an area of the inner surface of the large-diameter portion located in an opposite side of a central axis of the large-diameter portion from the projecting portion of the tapered portion.

2. The method for molding a pipe body according to claim 1, wherein the core metal further comprises a second core metal piece for molding the large-diameter portion, and wherein, during the molding of the tubular body, the second core metal piece abuts on an area of an inner surface of the large-diameter portion located in the opposite side of the central axis of the large-diameter portion from the projecting portion of the tapered portion.

3. The method for molding a pipe body according to claim 2, wherein the removal of the core metal comprises:

moving of the first core metal piece within the tubular body away from the projecting portion of the tapered portion; and removal of the first core metal piece and the second core metal piece from the large-diameter portion in a direction away from the tapered portion upon the moving of the first core metal piece.

4. The method for molding a pipe body according to claim 2, wherein the removal of the core metal comprises:

removal of the first core metal piece from the tapered portion in a direction away from the large-diameter portion; and removal of the second core metal piece from the large-diameter portion in a direction away from the tapered portion upon the removal of the first core metal piece.

5. The method for molding a pipe body according to claim 2, wherein the removal of the core metal comprises:

removal of the second core metal piece from the large-diameter portion in a direction away from the tapered portion; and removal of the first core metal piece from the large-diameter portion in a direction away from the tapered portion upon the removal of the second core metal piece.

* * * * *